US008575080B2

(12) United States Patent
Katafuchi

(10) Patent No.: US 8,575,080 B2
(45) Date of Patent: Nov. 5, 2013

(54) LUBRICATING OIL COMPOSITION FOR DIESEL ENGINE

(75) Inventor: Tadashi Katafuchi, Chiba (JP)

(73) Assignees: Idemitsu Kosan Co., Ltd., Tokyo (JP); Petroleum Energy Center, A Juridical Incorporated Foundation, Tokyo (JP)

( * ) Notice: Subject to any disclaimer, the term of this patent is extended or adjusted under 35 U.S.C. 154(b) by 0 days.

(21) Appl. No.: 13/539,643

(22) Filed: Jul. 2, 2012

(65) Prior Publication Data

US 2013/0005623 A1 Jan. 3, 2013

Related U.S. Application Data

(63) Continuation of application No. 10/590,934, filed as application No. PCT/JP2005/006123 on Mar. 30, 2005, now abandoned.

(30) Foreign Application Priority Data

Mar. 31, 2004 (JP) ..... 2004-105934

(51) Int. Cl.
*C10M 133/16* (2006.01)

(52) U.S. Cl.
USPC ..... 508/192

(58) Field of Classification Search
USPC ..... 508/192, 287, 293
See application file for complete search history.

(56) References Cited

U.S. PATENT DOCUMENTS

| | | | | |
|---|---|---|---|---|
| 5,789,356 | A | 8/1998 | Tiffany, III | |
| 5,916,852 | A * | 6/1999 | Nibert et al. | 508/432 |
| 6,376,434 | B1 | 4/2002 | Katafuchi | |
| 2003/0220206 | A1 * | 11/2003 | Komiya et al. | 508/192 |
| 2004/0192562 | A1 | 9/2004 | Morita | |
| 2005/0181957 | A1 | 8/2005 | Koshima et al. | |
| 2006/0011257 | A1 | 1/2006 | Devall | |
| 2006/0135375 | A1 | 6/2006 | Buitrago et al. | |
| 2006/0160709 | A1 | 7/2006 | Koshima et al. | |

FOREIGN PATENT DOCUMENTS

| | | |
|---|---|---|
| JP | 59 500322 | 3/1984 |
| JP | 63 501155 | 4/1988 |
| JP | 2002 105478 | 4/2002 |
| JP | 2003 73685 | 3/2003 |
| JP | 2003 113391 | 4/2003 |
| WO | WO 2004/113477 | 12/2004 |

* cited by examiner

*Primary Examiner* — Jim Goloboy
(74) *Attorney, Agent, or Firm* — Oblon, Spivak, McClelland, Maier & Neustadt, L.L.P.

(57) ABSTRACT

A lubricating oil composition for diesel engines, particularly a composition with low ashes and no metals. The lubricating oil composition has exceedingly high detergency and excellent antiwear so that it is suitably used for diesel engines equipped with an apparatus for after-treatment of exhaust gas. The lubricating oil composition contains a lubricating base oil which includes a component (A): 2 to 30% by mass, based on the total amount of the composition, of a succinimide compound having an alkenyl group or an alkyl group of a number average molecular weight of 80 to 500 or a boronic compound thereof; and a component (B): 0.5 to 30% by mass, based on the total amount of the composition, of a succinimide compound having an alkenyl group of a number average molecular weight of 800 to 3,500 or a boronic compound thereof.

14 Claims, No Drawings

LUBRICATING OIL COMPOSITION FOR DIESEL ENGINE

CROSS-REFERENCE TO RELATED APPLICATIONS

This application is a continuation of U.S. Ser. No. 10/590,934 filed Aug. 28, 2006, pending, which is a National Stage of PCT/JP05/06123 filed Mar. 30, 2005 and claims the benefit of JP 2004-105934 filed Mar. 31, 2004.

TECHNICAL FIELD

The present invention relates to a lubricating oil composition for diesel engines, and more particularly to a lubricating oil composition for diesel engines, which comprises low ashes and no metals, has exceedingly high detergency so that it is suitably used for diesel engines equipped with an apparatus for after-treatment of exhaust gas.

BACKGROUND ART

Conventional lubricating oil for diesel engines has been required to exhibit high detergency and antiwear, since it has been frequently used under the severe conditions. Therefore, such lubricating oil for diesel engines comprises, as a detergent-dispersant, sulfonate, phenate, salicylate and phosphonate of alkaline earth metal or alkaline metal, and overbased compounds thereof, which are metal based detergent-dispersants.

Further, zinc dialkyldithiophosphate (Zn-DTP) has been incorporated therein so as to keep antiwear thereof. Meanwhile, diesel engines have been utilized extensively due to their high power and good thermal efficiency. However, there has been an important issue for taking antipollution measures and prime task of reducing NOx (nitrogen oxides) and PM (particulate: Particulate Matter).

As one of those measures, it has been conducted for reducing NOx to lower a combustion peak temperature by heightening exhaust gas recirculation (EGR) ratio or retarding fuel-injection timing. However, if the combustion peak temperature is lowered, black smoke and PM increase, therefore it is required to install a device for an exhaust gas post-treatment.

As the exhaust gas post-treatment device, DPF (diesel particulate filter) for trapping PM or oxidation catalysts have been investigated. However, since both of them have filter structure, there have been the plugging problems thereof caused by metals in conventional diesel lubricating oils when the oils were used.

In addition, the reduction of the metal content, which means reduction of metal-based detergents and antiwear agents, causes deterioration of detergency and antiwear.

Therefore, there has been actively conducted development of lubricating oils for diesel engines having low ashes, high detergency and antiwear while eliminating incorporation of metal-based detergent-dispersants, Zn-DTP or the like, or reducing amount thereof, and proposed some approaches: for example, Patent literature 1 is referred. However, those approaches have fallen short of detergency and antiwear, and further improvement of performances has been desired.

Patent literature 1: Japanese Patent Application Laid-Open No. 2003-73685

DISCLOSURE OF THE INVENTION

The present invention has been conducted in the above circumstances and its objective is to provide a lubricating oil composition for diesel engines, which comprises low ashes and no metals, has exceedingly high detergency and also exhibits excellent antiwear so that it does not damage performance of an apparatus for after-treatment of exhaust gas.

The present inventor found that the detergency was improved by combining an alkenyl or alkyl succinimide compound or a boronic compound thereof, and an alkenyl succinimide compound or a boronic compound thereof "these will be occasionally referred to as succinimide compounds totally, hereinafter", and the former and the latter have a different molecular weight each other. The present invention has been completed based on such knowledge.

Namely, the present invention provides the following:

(1) a lubricating oil composition for diesel engines, characterized in that a lubricating base oil comprises a component (A): 2 to 30% by mass, based on the total amount of the composition, of a succinimide compound having an alkenyl group or an alkyl group of a number average molecular weight of 80 to 500 or a boronic compound thereof, and a component (B): 0.5 to 30% by mass, based on the total amount of the composition, of a succinimide compound having an alkenyl group of a number average molecular weight of 800 to 3,500 or a boronic compound thereof.

(2) the lubricating oil composition for diesel engines according to the above (1), wherein the component (A) comprises a mono-based succinimide compound or a boronic compound thereof.

(3) the lubricating oil composition for diesel engines according to the above (1) or (2), wherein the component (A)/the component (B), which represents the blending ratio by mass of the component (A) to the component (B), is in the range of 0.3 to 10.

(4) the lubricating oil composition for diesel engines according to any one of the above (1) to (3), comprising boron content of 30 ppm by mass or more.

(5) the lubricating oil composition for diesel engines according to any one of the above (1) to (4), further comprising an ashless antiwear agent of a component (C).

(6) the lubricating oil composition for diesel engines according to the above (5), wherein the ashless antiwear agent is a non-phosophoric antiwear agent.

(7) the lubricating oil composition for diesel engines according to any one of the above (1) to (6), comprising a sulfated ashes content of 0.8% by mass or less.

(8) the lubricating oil composition for diesel engines according to any one of the above (1) to (7), comprising no metals.

The lubricating oil composition for diesel engines of the present invention comprises low ashes and no metals, has exceedingly high detergency and also exhibits excellent antiwear. Therefore, it does not damage performance of an apparatus for aftertreatment of exhaust gas.

BEST MODES FOR CARRYING OUT THE INVENTION

The lubricating oil composition for diesel engines of the present invention comprises a base oil and two kinds of succinimide compounds. A base oil to be used for the present invention includes, but is not particularly limited to, a mineral oil-based lubricating base oil and a synthetic oil-based lubricating base oil. The mineral oil-based base oil includes, for example, a product obtained by application of a process comprising at least a method selected from the group consisting of solvent refining, hydrocracking, hydrotreating, solvent dewaxing, hydrodewaxing, wax isomerization and the like of a product obtained from dewaxing a lubricating oil fraction which is produced from atmospheric distillation and vacuum distillation of crude oil. In particular, a base oil hardly comprising sulfur or aromatics, which is produced hydrocracking, hydrotreating, hydrodewaxing, and wax isomerization, is preferable.

Further, examples of the synthetic oil-based base oil include alkylbenzene, alkylnaphtharene, polybutene or hydrogenated compounds thereof, poly-α-olefin such as 1-decene oligomer or hydrogenated thereof, diester such as dioctyladipate and dioctylsebacate and polyolester such as trimetlylolpropanecaprilate, pentaerythritol-2-ethylhexanoate. Among those, poly-α-olefin such as 1-decene oligomer or a hydrogenated compound thereof is employed preferably.

The base oil to be used for the present invention having a kinematic viscosity at 100° C. of 2 to 35 $mm^2/s$, particularly 3 to 25 $mm^2/s$ is preferable. The antiwear is good when the kinematic viscosity at 100° C. is 2 $mm^2/s$ or larger, and the deterioration of fuel consumption is controlled and its performance at low temperature meet the case, when the kinematic viscosity at 100° C. is 35 $mm^2/s$ or smaller. In addition, the viscosity index of the base oil to be used for the present invention is not limited to, but preferably 95 or larger, more preferably 100 or larger and in particular preferably 105 or larger.

By increasing the viscosity index, it is possible to control oil consumption, and also improve its performance at low temperature and fuel consumption. Therefore, it may be possible to obtain a base oil having a desired viscosity or a desired viscosity index by blending at least one kind of the above mineral based-base oil and the above synthetic based-base oil.

The first succinimide compound includes the component (A): the succinimide compound having an alkenyl group or an alkyl group of a number average molecular weight of 80 to 500, preferably 130 to 250 or a boronic compound thereof. As the succinimide compound, a mono-based succinimide compound is preferable, and examples thereof is represented by the general formula [1]

[1]

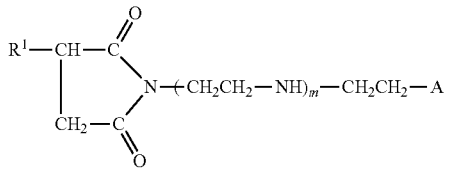

In the general formula [1], $R^1$ represents an alkenyl group or alkyl group of a number average molecular weight of 80 to 500, preferably 130 to 250, and also it may include either a straight-chain or a branched-chain thereof. When a number average molecular weight of $R^1$ is less than 80, the solubility of the succinimide compounds to the base oil may be insufficient. When a number average molecular weight of $R^1$ is more than 500, it may be difficult to impart adequate detergency thereto due to its lowered base value.

Preferable examples of the alkenyl group or the alkyl group includes particularly a decyl group (a number average molecular weight: 141), a decenyl group, a dodecyl group, a dodecenyl group, a tetradecyl group, a tetradecenyl group, a hexadecyl group, a hexadecenyl group, an octadecyl group, an octadecenyl group, an eicocyl group, an eicocenyl (a number average molecular weight: 240) and the like.

In the general formula [1], m represents an integer of 0 to 3. When m is less than 3, the solubility of the succinimide compounds to the base oil is good. A polyamine to be employed for control m properly includes, for example, an alkyldiamine such as ethylenediamine, propanediamine, butanediamine, N-methyl-1,3-propanediamine and N,N-dimethyl-1,3-propanediamine, a polyalkylenediamine such as diethylenetriamine, triethylenetetramine and tetraethylenepentamine, a polyalkylenepolyamine having cyclicalkyleneamine such as aminoethylpiperazine and the like. In addition, A group in the general formula [1] represents an amino group or a N-piperazyl group.

A process for manufacturing the above succinimide compounds is not specifically limited. The succinimide compounds may be produced following process:

First, alkenyl or alkyl succinimide, or alkenyl or alkyl succinic anhydride and a polyamine are mixed at the molar ratio of 1:10 to 10:1. Subsequently, the reaction may be carried out at a reaction temperature of about 120 to 200° C. and under a reaction pressure of about 0.1 to 1 MPa.

Further, a process for manufacturing the boronic compounds of the succinimide compounds of the present invention comprises a reaction of the above succinimide compounds with a compound comprising boron. The reaction is carried out at the mixing ratio of the compounds comprising boron to the polyamines of 1:0.01 to 10. The boron compounds include, for example, boron oxide, boron halide, boric acid, boric acid anhydride, boric acid ester and the like. The boronic compounds of the succinimide compounds comprising generally 0.05 to 5% by mass, preferably 0.1 to 3% by mass of boron may be used.

The succinimide compounds as above component (A) exert effect to increase the base value of the composition and enhance detergency thereof in the presence of the succinimide compounds as the component (B) explained below.

The lubricating oil composition for diesel engines of the present invention comprises 2 to 30% by mass, preferably 3 to 20% by mass of a succinimide compound of the component (A). In this case, it may be possible to incorporate a mixture of a succinimide compound and a boronic compound thereof to the composition. Although the mixing ratio thereof is optional, it is preferable to control the mixing ratio so as to be a preferable content of boron in the composition as explained below.

In addition, the second succinimide compound includes the component (B): the succinimide compounds having an alkenyl group of a number average molecular weight of 800 to 3,500, preferably 900 to 2,500 or boronic compounds thereof. The succinimide compound to be used includes either a mono-based one or a bis-based one, and includes, for example, the compounds represented by the following general formulae [2] and [3].

[2]

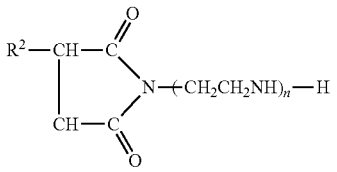

-continued

[3]

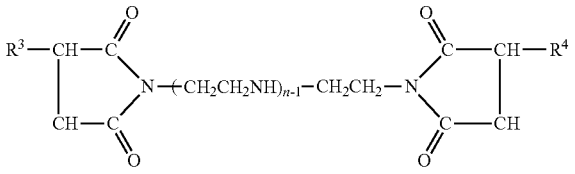

$R^2$ in the general formula [2], and $R^3$ and $R^4$ in the general formula [3] each independently represent a polybutenyl group having a number average molecular weight of 800 to 3,500, preferably 900 to 2,500. When the number average molecular weight thereof is less than 800, it is not suitable to be used since it may be feared that soot dispersibility drops to a lower value. On the other hand, when it is more than 3,500, it may be feared to obtain the objective performance due to lowering detergency.

In the general formulae [2] and [3], n represents an integer of preferably 2 to 5, more preferably 3 to 4. When n represents 2 or larger, detergency accepted as synergy effect thereof is good, and when n represents 5 or smaller, the solubility thereof into the base oil is good, therefore the good storage stability is achieved.

A process for manufacturing the above polybutenylsuccinimide is not specifically defined. For example, they may be produced through a process similar to the process for succinimide as the above component (A) and other conventional processes.

In addition, a process for manufacturing the boronic compounds of the polybutenylsuccinimide may be a process similar to the process for manufacturing the boronic compounds of succinimide compounds of the component (A). The boron compounds of the succinimid compounds comprising boron of generally 0.05 to 5% by mass, preferably 0.1 to 3% by mass may be used for the component (B).

The succinimide compounds as the component (B) act to boost particularly detergency and dispersibility in the presence of the succinimide compounds of the component (A). The lubricating oil composition for diesel engines of the present invention comprises 0.5 to 30% by mass, preferably 1 to 20% by mass, more preferably 1.5 to 10% by mass of the succinimide compounds of the component (B). In this case, similar to the case of the succinimide compounds of the component (A), it may be possible to incorporate a mixture of a succinimide compound and a boronic compound thereof to the composition explained below as appropriate.

The mixing ratio (A)/(B) by mass of the succinimide compounds of the component (A) to the succinimide compounds of the component (B) is preferably 0.3 to 10, and more preferably 0.5 to 5. When the ratio (A)/(B) by mass is in the range of the above, the synergy effect thereof is demonstrated and detergency may be improved exceedingly.

The lubricating oil composition for diesel engines of the present invention comprises 30 ppm by mass or more, preferably 100 ppm by mass or more, and more preferably 200 ppm by mass or more of boron in the composition. When the boron content is 30 ppm by mass or more, the antiwear is kept adequately and detergency is good. The boron is derived from succinimide compounds of the components (A) and (B), and the content in the composition may preferably be 30 ppm by mass or more in total. Therefore, boron may be derived only from the component (A) or the component (B), or both components (A) and (B).

The lubricating oil composition for diesel engines of the present invention may improve detergency and maintain antiwear so as to achieve the objective by incorporating the components (A) and (B), and also it is possible to incorporate an ashless antiwear agent (C) therein. The ashless antiwear agent includes, but not limited to, preferably a non-phosophoric antiwear agent. Examples thereof include fatty acids having carbon atoms of 12 to 24 such as oleic acid, esters having carbon atoms of 13 to 40 such as methyl oleate, alcohols having carbon atoms of 12 to 24 such as oleyl alcohol, amids having carbon atoms of 12 to 40 such as oleamide, amines having carbon atoms of 12 to 40 such as oleylamine and sulfur compounds having carbon atoms of 3 to 30 such as monosulfide, disulfide, polysulfide and the like.

Particularly preferable antiwear agents include sulfur compounds having carbon atoms of 3 to 30, more particularly disulfide compounds, and dibenzylsulfide may be illustrated as an example. An amount of 0.1 to 10% by mass, preferably 0.2 to 5% by mass of the ashless antiwear agents may be contained in the composition, based on the total amount of the composition.

The lubricating oil composition for diesel engines of the present invention may achieve the objective by incorporating the components (A) and (B) or the components (A), (B) and (C) into the base oil. Further, the composition may be preferred to have the following properties:

It may contain 0.8% by mass or less, preferably 0.5% by mass or less, more preferably 0.3% by mass or less of sulfated ashes. Since the lower content of the sulfated ashes can control the plugging of DPF, a prolonged lifetime thereof is available. In addition, the lubricating oil composition for diesel engines of the present invention comprises no metals so that a prolonged lifetime thereof is available.

Further, the kinematic viscosity at 100° C. thereof is preferably in the range of 2 to 20 $mm^2/s$, more preferably in the range of 3 to 15 $mm^2/s$. When it is 2 $mm^2/s$ or larger, the antiwear is good, and when it is 20 $mm^2/s$ or less, deterioration of fuel consumption may be controlled.

It is preferable to have a base value of 1 mg KOH/g or larger, and particularly 2 mg KOH/g or larger. When it is 1 mg KOH/g or larger, the composition has adequate acid neutralization capacity so as to maintain detergency under the severe conditions.

The lubricating oil for diesel engines of the present invention may further contain a wide variety of additives for any purpose. Such additives include a viscosity index improver such as dispersed or non-dispersed polymethacrylate, ethylene-propylene copolymer and polyisobutylene, a non-metallic detergent-dispersant such as succinimide other than above (A) and (B) and a boronic compound thereof, a pour point depressant such as polymethacrylate and a condensed product of chlorinated paraffin and naphthalene, a phenol-based or amine-based antioxidant, a antifoaming agent such as a silicone based compound and a polyacrylate-based compound. Although an adding amount of those additives may be selected properly as appropriate, they are incorporated therein in an amount of generally 0.0001 to 30% by mass. However, it is preferable to incorporate them therein so as to be the content of the sulfated ashes of 0.8% by mass or less.

EXAMPLE

The present invention shall be explained below in further details with reference to examples and comparative examples, but the present invention shall by no means be restricted by the following examples. In addition, property and performance of the lubricating oils for diesel engines have been determined as follows:

Property of the Lubricating Oils (1) Sulfated ashes test: measured based on JIS K 2544
(2) Base value: measured based on JIS K 2501
(3) Kinematic viscosity: measured based on JIS K 2283
(4) Boron content: measured based on ICP emission spectrometry Performance of the Lubricating Oils (1) Hot tube test: a lubricating oil under the test at 0.6 milliliter/hr and air at 10 milliliter/min were passed for 8 hours through a glass tube, which was kept at 300° C., having an internal diameter of 2 mm. Subsequently, the lacquer adhered on the inner surface of the glass tube was compared with color cards and the score was given. When the lacquer is clear, the score is 10, and when it is black, it is 0. The higher the score, the more excellent the detergency (at high temperature) is. In addition, each test sample was measured for the remained base value.

(2) Antiwear test

By employing the Soda four-ball test machine, under the condition of at 80° C. of oil temperature and 500 rpm of revolution, there was measured the load at which electric conductivity was observed clearly between the revolving ball and fixed balls while the load was gradually increased from 0.048 MPa by 0.196 MPa every three minutes. The load was evaluated as the complete contact load. The higher the complete contact load is, the more excellent the antiwear is.

Examples 1 to 5, and Comparative Examples 1 and 2

As shown in Table 1, the lubricating oil compositions of the present invention (Examples 1 to 5) and the lubricating oil compositions for the comparison (Comparative Examples 1 and 2) were prepared, and properties and performances thereof were evaluated. The evaluation results were shown in Table 1.

INDUSTRIAL APPLICABILITY

The lubricating oil composition for diesel engines of the present invention comprises low ashes and no metals, has exceedingly high detergency and excellent antiwear so that it is suitably used for diesel engines equipped with an apparatus for after-treatment of exhaust gas.

What we claim is:

1. A method of lubricating a diesel engine with a lubricating oil composition, the method comprising providing the lubricating oil to the diesel engine, and wherein the lubricating oil comprises a lubricating base oil selected from the group consisting of a hydrotreated mineral oil and a synthetic oil; and:

component (A): 5 to 20% by mass, based on the total amount of the composition, of a mono-based succinimide compound having an alkenyl group or an alkyl group of a number average molecular weight of 130 to 250 or a boronic compound thereof, and component (B): 2 to 10% by mass, based on the total amount of the composition, of a succinimide compound having an alkenyl group of a number average molecular weight of 800 to 3,500, wherein the lubricating oil composition comprises a boron content of 100 ppm by mass or more and has a sulfated ashes content of 0.8% by mass or less.

2. The method according to claim 1, wherein the component (A)/the component (B), which represents the blending ratio by mass of the component (A) to the component (B), is in the range of 0.3 to 10.

3. The method according to claim 1, wherein the lubricating oil composition comprises a boron content of 200 ppm by mass or more.

4. The method according to claim 1, wherein the lubricating oil composition further comprises an ashless antiwear agent.

5. The method according to claim 4, wherein the ashless antiwear agent is a non-phosophoric antiwear agent.

6. The method according to claim 1, wherein the lubricating oil composition comprises no metals.

TABLE 1

| | | Example 1 | Example 2 | Example 3 | Example 4 | Example 5 | Comparative Example 1 | Comparative Example 2 |
|---|---|---|---|---|---|---|---|---|
| Composition (mass %) | Base Oil*1 | 93 | 93 | 93 | 92.5 | 92 | 95 | 98 |
| | Component (A) | | | | | | | |
| | Succinimide A-1*2 | 2.5 | 5 | | | | 5 | |
| | Succinimide A-2*3 | 2.5 | | 5 | 5 | 5 | | |
| | Component (B) | | | | | | | |
| | Polybutenylsuccinimide B*4 | 2 | | 2 | | | | 2 |
| | Polybutenylsuccinimide B-2*5 | | 2 | | 2 | 2 | | |
| | Component (C) | | | | | | | |
| | Ashless antiwear agent*6 | 0 | 0 | 0 | 0.5 | 1 | 0 | 0 |
| Property & Performance | Kinematic Viscosity at 100° C. $mm^2/s$ | 12.0 | 12.0 | 11.5 | 11.5 | 11.5 | 11.0 | 10.5 |
| | Base value mg KOH/g | 5.2 | 5.1 | 5.3 | 5.1 | 5.1 | 4.5 | 0.7 |
| | Boron content ppm by mass | 500 | 40 | 950 | 1000 | 990 | 0 | 0 |
| | Sulfated ashes % by mass | <0.1 | <0.1 | <0.1 | <0.1 | <0.1 | <0.1 | <0.1 |
| | Detergency: Hot Tube test | | | | | | | |
| | Score | 8 | 7 | 8 | 8 | 7 | 0 | 0 |
| | Remained Base Value mg KOH/g | 1.3 | 1.1 | 1.3 | 1.1 | 1.1 | 0.9 | 0 |
| | Antiwear test: Complete contact load MPa | 0.069 | 0.069 | 0.069 | 0.088 | 0.088 | <0.049 | <0.049 |

*1hydrotreated mineral oil: kinematic viscosity at 100° C.; 9.24 $mm^2/s$, viscosity index; 106, sulfur content; <5 ppm by mass

*2decenylsuccinimide (mono-based): nitrogen content; 58,000 ppm by mass

*3boronic compound of decenylsuccinimide (mono-based): nitrogen content; 55,000 ppm by mass, boron content; 19,000 by mass

*4polybutenyl group having number average molecular weight of 1,000, succinimide (bis-based): nitrogen content; 2,100 ppm by mass

*5polybutenyl group having number average molecular weight of 1,000, boronic compound of succinimide (bis-based): nitrogen content; 1,800 ppm by mass

*6dibenzyldisulfide

7. The method according to claim 1, wherein the lubricating oil composition comprises a boron content of 200 ppm by mass or more, and wherein the base oil has a kinematic viscosity at 100° C. of 2 to 35 $mm^2/s$ and the mixing ratio (A)/(B) by mass of the succinimide compounds of component (A) to the succinimide compounds of component (B) is 0.5 to 5.

8. The method according to claim 1, wherein the lubricating oil composition comprises a mono-based succinimide compound represented by the general formula [1]:

[1]

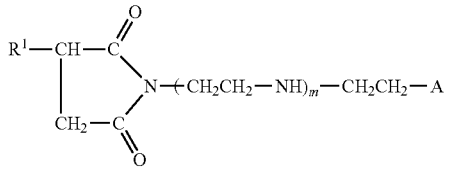

where $R^1$ represents an alkenyl group or alkyl group of a number average molecular weight of 130 to 250, m represents an integer of 0 to 3, and A represents an amino group or a N-piperazyl group.

9. The method according to claim 1, wherein the lubricating oil composition comprises a boronic compound of a mono-based succinimide compound represented by the general formula [1]:

[1]

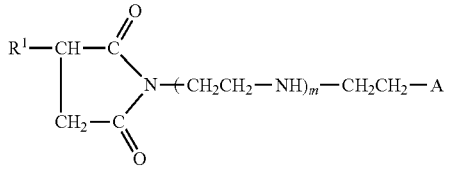

where $R^1$ represents an alkenyl group or alkyl group of a number average molecular weight of 130 to 250, m represents an integer of 0 to 3, and A represents an amino group or a N-piperazyl group.

10. The method according to claim 1, wherein the lubricating oil composition comprises as component (B) a succinimide compound having an alkenyl group of a number average molecular weight of 900 to 2,500.

11. The method according to claim 1, wherein the lubricating oil composition comprises a compound represented by the following general formula [2]:

[2]

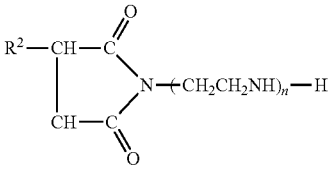

where $R^2$ represents a polybutenyl group having a number average molecular weight of 800 to 3,500 and n represents an integer of 2 to 5.

12. The method according to claim 1, wherein the lubricating oil composition comprises a compound represented by the following general formula [3]:

[3]

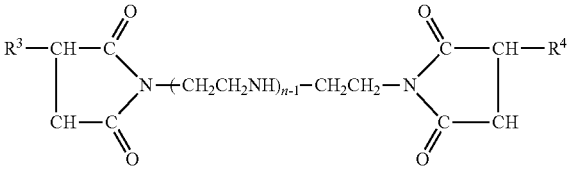

where $R^3$ and $R^4$ each independently represent a polybutenyl group having a number average molecular weight of 800 to 3,500 and n represents an integer of 2 to 5.

13. The method according to claim 9, wherein said boronic compound is prepared by reacting said compound of formula 1 with boron oxide, boron halide, boric acid, boric acid anhydride, or a boric acid ester.

14. The method according to claim 1, wherein the lubricating oil composition comprises 5 to 20% by mass, based on the total amount of the composition, of a mono-based succinimide compound having an alkenyl group or an alkyl group of a number average molecular weight of 130 to 250.

* * * * *